US009447651B2

(12) United States Patent
Hallundbæk

(10) Patent No.: US 9,447,651 B2
(45) Date of Patent: Sep. 20, 2016

(54) SEALING SYSTEM

(75) Inventor: Jorgen Hallundbæk, Graested (DK)

(73) Assignee: WELLTEC A/S, Allerød (DK)

( * ) Notice: Subject to any disclaimer, the term of this patent is extended or adjusted under 35 U.S.C. 154(b) by 281 days.

(21) Appl. No.: 13/819,478

(22) PCT Filed: Aug. 30, 2011

(86) PCT No.: PCT/EP2011/064911

§ 371 (c)(1),
(2), (4) Date: Feb. 27, 2013

(87) PCT Pub. No.: WO2012/028616

PCT Pub. Date: Mar. 8, 2012

(65) Prior Publication Data

US 2013/0160999 A1 Jun. 27, 2013

(30) Foreign Application Priority Data

Aug. 31, 2010 (EP) ..... 10174670

(51) Int. Cl.
*E21B 29/10* (2006.01)
*E21B 43/10* (2006.01)

(52) U.S. Cl.
CPC ..... *E21B 29/10* (2013.01); *E21B 43/10* (2013.01); *E21B 43/103* (2013.01)

(58) Field of Classification Search
CPC ..... E21B 33/00; E21B 33/10; E21B 33/13; E21B 47/10; E21B 43/10; E21B 43/103; E21B 43/108
See application file for complete search history.

(56) References Cited

U.S. PATENT DOCUMENTS 3,297,092 A * 1/1967 Jennings ..... 166/207
5,283,520 A * 2/1994 Martin et al. ..... 324/220
5,390,742 A * 2/1995 Dines ..... E21B 17/00 166/242.1
5,426,367 A * 6/1995 Martin et al. ..... 324/339

(Continued)

FOREIGN PATENT DOCUMENTS

EP 2 143 876 1/2010
RU 2 203 414 C1 4/2003

(Continued)

OTHER PUBLICATIONS

International Preliminary Report on Patentability for PCT/EP2011/064911, dated Mar. 5, 2013.

(Continued)

*Primary Examiner* — Elizabeth Gitlin
(74) *Attorney, Agent, or Firm* — Nixon & Vanderhye P.C.

(57) ABSTRACT

The present invention relates to sealing method for sealing a zone of a casing in a well, the zone comprising several leaks, perforations and/or weakened casing parts, or other irregularities having a casing characteristic which, when measured, is found to be outside a predetermined interval. The sealing method comprises the steps of measuring the characteristics of the casing, determining a position of the zone, determining an extent of the zone in a longitudinal direction of the casing, determining a part of the zone and an extent of the part whose casing characteristic when measured is within the predetermined interval, the part extending in the longitudinal direction of the casing, positioning a first liner overlapping the first area of the part of the casing, positioning a second liner overlapping the second area of the part of the casing, expanding the first liner, and expanding the second liner.

16 Claims, 9 Drawing Sheets

(56) References Cited

U.S. PATENT DOCUMENTS

| | | | | |
|---|---|---|---|---|
| 5,785,120 | A * | 7/1998 | Smalley et al. | 166/55 |
| 5,957,195 | A * | 9/1999 | Bailey et al. | 166/55 |
| 6,142,230 | A * | 11/2000 | Smalley et al. | 166/277 |
| 7,681,640 | B2 * | 3/2010 | Bixenman et al. | 166/250.01 |
| 2003/0090390 | A1 * | 5/2003 | Snider | E21B 17/006 340/853.3 |
| 2006/0065391 | A1 | 3/2006 | Carr | |
| 2007/0000664 | A1 * | 1/2007 | Ring et al. | 166/277 |
| 2007/0084637 | A1 * | 4/2007 | Orban et al. | 175/53 |
| 2007/0095532 | A1 * | 5/2007 | Head et al. | 166/277 |
| 2009/0151930 | A1 | 6/2009 | Giroux | |
| 2009/0195244 | A1 * | 8/2009 | Mouget et al. | 324/221 |
| 2010/0017137 | A1 * | 1/2010 | Legendre et al. | 702/11 |

FOREIGN PATENT DOCUMENTS

| | | | |
|---|---|---|---|
| RU | 33 223 | U1 | 10/2003 |
| RU | 2 237 796 | C1 | 10/2004 |
| RU | 2 273 718 | C1 | 4/2006 |
| RU | 2 289 013 | C1 | 12/2006 |
| RU | 2 338 053 | C2 | 11/2008 |
| SU | 987548 | A1 | 1/1983 |
| SU | 1051222 | A1 | 10/1983 |
| SU | 1601330 | | 4/1988 |
| WO | WO 2008/131771 | | 11/2008 |

OTHER PUBLICATIONS

International Search Report for PCT/EP2011/064911, mailed Oct. 27, 2011.

Written Opinion of the International Searching Authority for PCT/EP2011/064911, mailed Oct. 27, 2011.

* cited by examiner

SEALING SYSTEM

This application is the U.S. national phase of International Application No. PCT/EP2011/064911, filed 30 Aug. 2011, which designated the U.S. and claims priority to EP Application No. 10174670.9, filed 31 Aug. 2010, the entire contents of each of which are hereby incorporated by reference.

FIELD OF THE INVENTION

The present invention relates to a sealing method for sealing a zone of a casing in a well, the zone comprising several leaks, perforations and/or weakened casing parts, or other irregularities having a casing characteristic which, when measured, is found to be outside a predetermined interval. The sealing method comprises the steps of measuring the characteristics of the casing, determining a position of the zone, determining an extent of the zone in a longitudinal direction of the casing, determining a part of the zone and an extent of the part whose casing characteristic when measured is within the predetermined interval, the part extending in the longitudinal direction of the casing, at least in a first and a second area, positioning a first liner overlapping the first area of the part of the casing, positioning a second liner overlapping the second area of the part of the casing, expanding the first liner, and expanding the second liner. The invention furthermore relates to a downhole system for performing the sealing method.

BACKGROUND ART

A downhole casing in a well bore may have several leaks and/or weakened casing parts or other irregularities which must be sealed off to secure that no unintended fluid or gases enter the casing through the leaks or potential leaks in the weakened casing parts.

Also, the downhole casing may have perforations made for allowing crude oil or gases to enter the casing from the surrounding formation. However, it may also be necessary to seal off these perforations when the layer of oil has moved to ensure that no unintended fluid, such as water, enters the casing and mixes with the oil or gas.

In prior art solutions, the sealing of leaks, perforations and/or weakened casing parts, or other irregularities downhole in a casing is performed by introducing liners or patches into the casing, positioning the liners opposite the leaks, perforations and/or weakened casing parts, and subsequently expanding the liners.

Due to the present production technology, it is not possible to produce patches having a certain length while still maintaining their expansion ability without them breaking. However, when sealing off a perforation zone, the patches used are often not long enough, making it necessary to use several patches. Therefore, many attempts have been made to develop a solution where patch pieces overlap, as shown in FIG. 1. The prior art solution of FIG. 1 shows a leak in a casing, which has been sealed by means of two patch pieces. However, using two or more patch pieces with overlapping ends to obtain a secure sealing along the entire patch area has proven very difficult to handle downhole, as shown in FIGS. 2 and 3.

As shown in FIG. 2, when expanding the patch pieces, they may overlap too much, resulting in one of the patch pieces projecting inwards from the other patch piece, thereby reducing the inner diameter of the casing. This failure requires additional work to remove the projecting part to ensure that the inner diameter of the casing is not reduced any more than absolutely necessary. This takes time, and removing the projecting part may risk new leaks occurring.

To avoid the patch pieces overlapping too much, they may be placed with a smaller overlap, but the intended overlap between the patch pieces is often not large enough, resulting in an opening between the patches, which still creates a leak area, as shown in FIG. 3.

SUMMARY OF THE INVENTION

It is an object of the present invention to wholly or partly overcome the above disadvantages and drawbacks of the prior art. More specifically, it is an object to provide an improved method and system for sealing a zone of a casing in a well, the zone comprising several leaks, perforations and/or weakened casing parts or other irregularities.

The above objects, together with numerous other objects, advantages, and features, which will become evident from the below description, are accomplished by a solution in accordance with the present invention by a sealing method for sealing a zone of a casing in a well, the zone comprising several leaks, perforations and/or weakened casing parts, or other irregularities having a casing characteristic which, when measured, is found to be outside a predetermined interval, comprising the steps of:

- measuring the characteristics of the casing,
- determining a position of the zone,
- determining an extent of the zone in a longitudinal direction of the casing,
- determining a part of the zone and an extent of the part whose casing characteristic when measured is within the predetermined interval, the part extending in the longitudinal direction of the casing, at least in a first and a second area,
- positioning a first liner overlapping the first area of the part of the casing,
- positioning a second liner overlapping the second area of the part of the casing,
- expanding the first liner, and
- expanding the second liner.

The advantage of the above sealing method is that the need for long liners is reduced since the part of the casing forms part of the longer seal using two liners. By determining an acceptable part of the casing, overlap of two liners can be avoided, which may result in a decreased diameter or leaks. Furthermore, for production reasons, long liners are not able to expand as much as smaller liners and may therefore be difficult to handle during transportation.

In an embodiment of the invention, the first and second areas may not overlap in the longitudinal direction of the casing.

Furthermore, the measuring step may be performed by means of acoustics, such as ultrasound, vibration, sound or infrasound, capacitance, magnetism, X-ray, infrared light, visible light, laser, UV light, or microwaves.

In addition, the positioning step may be performed by means of a casing collar locator, a positioning tool using magnetism, or a distance measuring device.

Moreover, the expanding step may be performed by means of an expansion device.

The expansion device may comprise a mandrel, a cone, rollers, an expandable cone or mandrel, or the like.

In one embodiment, the method may comprise the step of measuring a thickness of the casing and the expanded liner in the zone.

Moreover, the method may comprise the step of measuring and determining a gap between the first and second expanded liners.

Additionally, the method may comprise the step of filling up the gab between the first and second expanded liners with a filling material.

This filling step may be a welding process.

Furthermore, the method may comprise the step of controlling that one end of the first expanded liner overlaps the casing opposite a first end of the zone, and that one end of the second expanded liner overlaps the casing opposite a second end of the zone.

In addition, the method may comprise the step of determining a second part of the casing zone as well as an extent of the second part whose casing characteristics are within the predetermined interval, the second part extending in the longitudinal direction of the casing, at least in a first and a second area.

Also, the method may comprise the step of positioning a third liner in an overlapping relationship with the second area of the second part.

Moreover, the method may comprise the step of cutting one or more of the liners into a predetermined length.

In an embodiment, the characteristic may be a result of a measurement corresponding to a wall thickness of the casing, a density of a material of the casing, a thermal conductivity of a material of the casing, a strength of a material of the casing, a porosity of a material of the casing, or a combination thereof.

In another embodiment, the predetermined interval may be a percentage of the wall thickness, a density of a material of the casing, a thermal conductivity of a material of the casing, a strength of a material of the casing, a porosity of a material of the casing, or a combination thereof.

The present invention furthermore relates to a downhole system for performing the method described above, comprising:

- a logging unit for measuring the characteristics of a casing downhole,
- a control unit for determining a position along the casing in which the characteristic has been measured, and
- a liner setting unit comprising at least two liners.

In an embodiment, the logging unit may comprise a means for performing ultrasound measurements, capacitance measurements, magnetism measurements, X-ray measurements, infrared light measurements, visible light measurements, UV light measurements and/or laser measurements.

In another embodiment, the control unit may be positioned above surface.

Moreover, the control unit may communicate with the logging unit and the liner setting unit via wireline.

Additionally, the control unit may secure that a first liner overlaps a first area of the part of the casing, and that a second liner overlaps a second area of the part of the casing.

Furthermore, the control unit may secure that one end of the first expanded liner overlaps the casing opposite a first end of the zone, and that one end of the second expanded liner overlaps the casing opposite a second end of the zone.

In an embodiment, the liner setting unit may comprise a body and at least one expansion device for expanding the liners.

Furthermore, the liner setting unit may comprise at least two liner setting tools, each liner setting tool comprising a liner, a body, an expansion device and a shaft for connecting the expansion device with the body.

In addition, the liner setting tool may comprise a plurality of liner setting tools.

Moreover, the liner setting unit may comprise the two liners, a body, an expansion device and a shaft for connecting the expansion device with the body.

Also, the liner setting unit may comprise the two liners arranged between two bodies and two expansion devices arranged between the two liners each moving towards one of the bodies for expanding one of the liners, the liner setting unit comprising a shaft for connecting the expansion devices with the bodies.

In an embodiment, the expansion device may comprise a mandrel, a cone, rollers, an expandable mandrel, or the like.

The downhole system described above may further comprise a positioning tool.

The positioning tool may be a casing collar locator, a positioning tool using magnetism, a distance measuring device or the driving unit.

Furthermore, the downhole system may comprise a driving unit for moving the downhole system in the casing.

Additionally, the system may comprise a plurality of driving units.

Moreover, the driving unit may be a downhole tractor.

Also, the system may be powered through wireline.

In addition, the system may be is connected with drill pipes or coiled tubing.

Furthermore, a pump may be arranged for powering the liner setting unit.

Moreover, a power unit for driving the pump, such as an electrical motor, may be arranged.

Additionally, the liner setting unit may comprise an expandable device and a liner.

Also, the system may comprise two expandable devices, one for each liner.

The expandable device may comprise an expansion body and a shaft.

This body may comprise fastening means.

The system may further comprise a cutting unit for cutting the liner into a predetermined length.

Furthermore, the liner may comprise sealing means.

Moreover, the logging unit may be adapted to measure a thickness of the casing and the expanded liner in the zone.

In addition, the logging unit may be adapted to measure and determine a gap between the first and second expanded liners.

Furthermore, the system may comprise a filling device for filling up the gab between the first and second expanded liners with a filling material.

Additionally, the filling device may be a welding apparatus.

Finally, the casing may comprise gas or crude oil.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

A casing 2 in a well 3 may be perforated in order for crude oil to pass from the formation into the casing and subsequently up to surface. During production, the oil layer in the formation may move in relation to the perforations 5, and the perforations must then be sealed off and new perforations be made opposite the new position of the oil layer. The section in which the casing 2 is perforated may vary, but often, one liner is not long enough to cover the entire perforated section.

Figure 1:
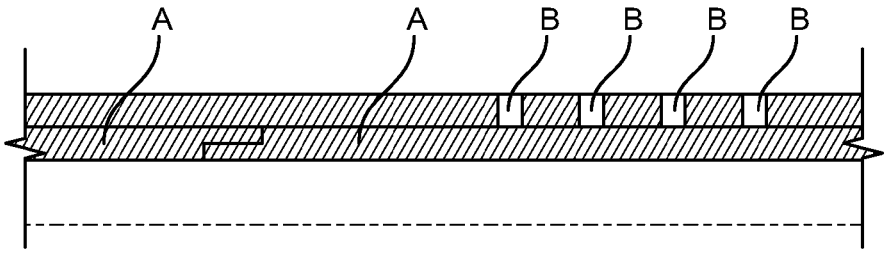
FIGS. 1-3 show a prior art solution in three different situations.

FIG. 1 shows a prior art solution in which a zone having perforations B in a casing has been sealed off with two patch pieces A. The present production technology does not allow for production of patches which are long enough and still being able to maintain their expansion ability without breaking. Therefore, many attempts have been made to develop a solution where patch pieces A overlap, as shown in FIG. 1. In FIG. 1, one patch has a profile matching the profile of another patch, meaning that when assembled, the patches do not decrease the inner diameter of one of the patches.

Figure 2:
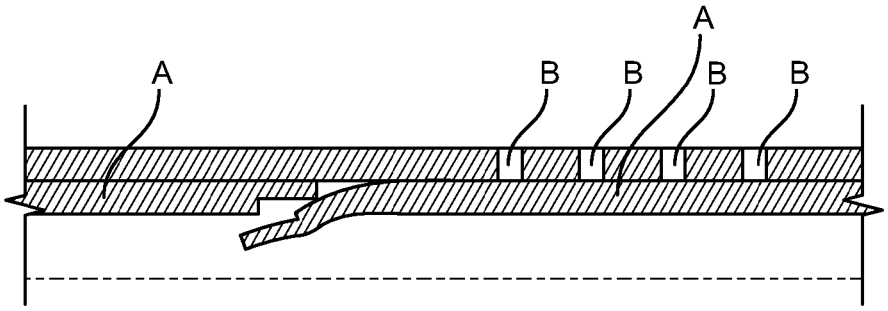

However, when placing two patches close to each other, there is a risk that they are placed inaccurately or dislocated while being expanded, which may cause them to overlap each other too much, as shown in FIG. 2. When the patches overlap, as shown in FIG. 2, the inner diameter of the patches is decreased in the overlapping zone, which is not acceptable since it will deteriorate the casing.

Figure 3:
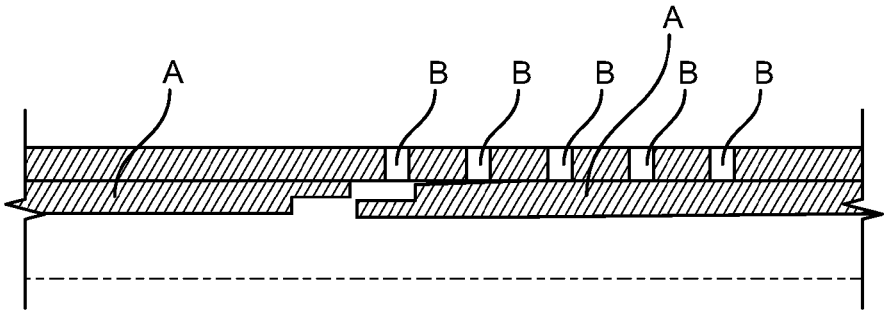

In another situation, the two patches have dislocated to an extent where they no longer overlap, meaning that they do not seal the perforations B, as shown in FIG. 3. When expanding a patch, the length pf the patch decreases, thereby increasing the chances of dislocation occurring.

In the event that two patches or liners overlap too much, it may be very difficult to remove the projecting part of the patch, which decreases the inner diameter of the casing part having the patch. Furthermore, if the patches do not overlap enough to have a sealing function, it may be necessary to insert an additional patch, which further decreases the inner diameter of the casing.

Figure 4:
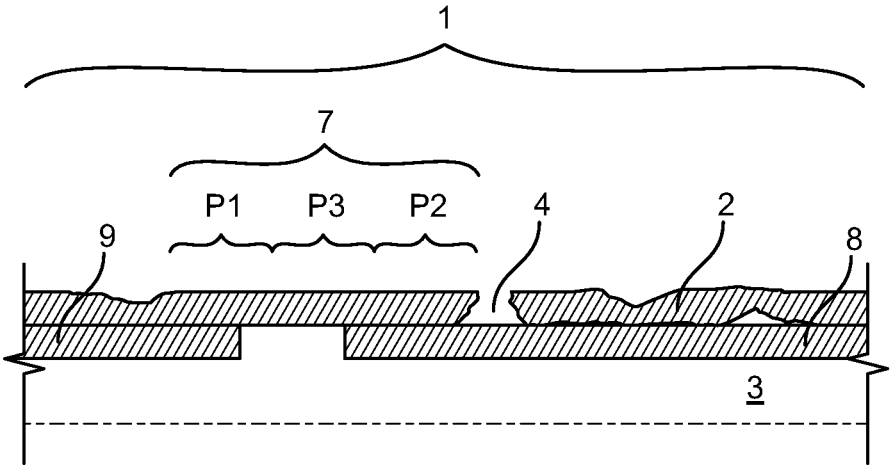
FIG. 4 shows two liners set in a zone having a leak and weak spots in the casing.
Figure 5:
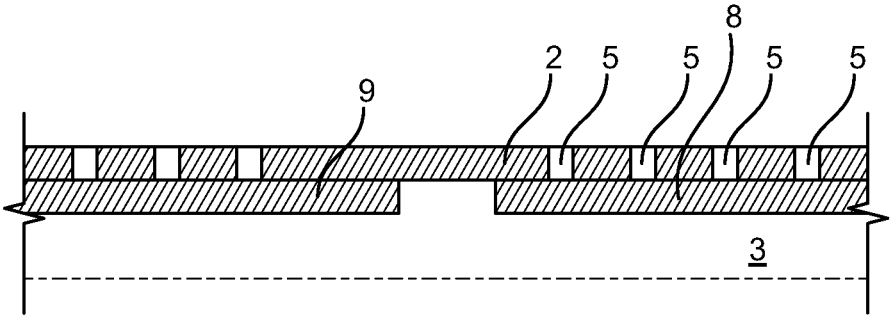
FIG. 5 shows two liners set in a zone with perforations in the casing.
Figure 6:
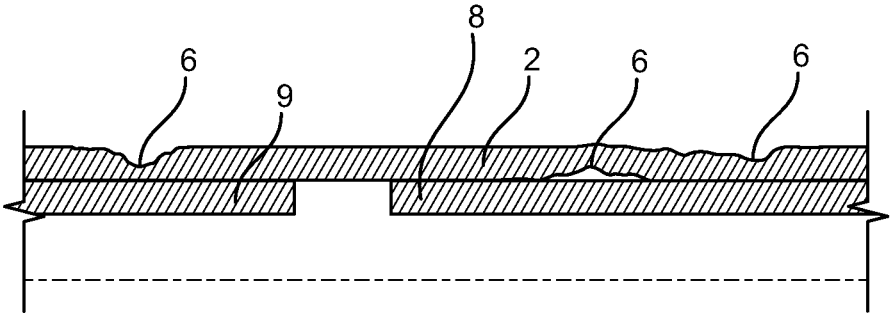
FIG. 6 shows two liners set in a zone having weak spots in the casing.

In the present invention, a logging unit 17 is used to measure a characteristic of the casing 2 downhole in order to determine a position of a zone 1 comprising a leak 4, perforations 5 and/or a weakened part. When the characteristic of the casing 2 has been measured and the extent of the zone 1 has been determined, parts 7 between the leak 4, perforations 5 and/or the weakened parts 6 of the casing having a normal casing characteristic, thereby being in good condition, are identified. By identifying that a part 7 of the casing 2 is in good condition, two liners can be arranged in a position where they overlap that part without overlapping each other, as shown in FIGS. 4-6. One liner overlaps the part 7 in a first area P1, the other liner overlaps the part 7 in a second area P2 while a third area P3 of the part 7 between the first and the second area is left free of overlapping the liners 8, 9. By having a sufficient third area P3, it is ensured that the liners do not overlap. Thus, the part 7 of the casing 2 needs to have a certain extent in order for the liners to have a sufficient overlap, and the third area must also have a sufficient length to prevent the liners from overlapping. Hereby, the liners 8, 9 and the casing part 7 together seal the perforations 5 or leaks 4, or the liners strengthen the weak parts without the risk of overlapping.

In FIG. 4, the liners 8, 9 are expanded to form a seal and strengthen any weak parts 6 in the casing 2. Parts of the casing 2 having an acceptable characteristic are identified, and the part 7 positioned closest the middle of the zone 1 and having a sufficient extent is chosen as the part to be overlapped by the liners.

In FIG. 5, a perforation zone is sealed off by means of liners 8, 9. A perforation zone often has parts between the perforations 5 whose characteristic is sufficient to be the part in which the liners can overlap. Often, the perforations 5 are made by a perforation gun which perforates the casing 2 in several runs. The runs are made with a predetermined time interval between them so that one run is made at a distance from the next run to ensure that the gun does not perforate where a perforation 5 already exists. The time interval and distance between two runs create a casing part which is not perforated and thus may form the part which the liners 8, 9 can overlap, as shown in FIG. 5.

The use of such double liners may also strengthen a casing zone 1 which has weak parts 6, as shown in FIG. 6. Between the weak parts 6, parts which have an acceptable casing characteristic, i.e. within a predetermined interval, are identified, and the liners 8, 9 are expanded so that they overlap one of these acceptable parts 7.

Before expanding a liner 8, 9, the inner wall of the casing 2 may be machined so that the surface becomes free of deposits or verdigris to enable a better fastening of the liners to the casing.

A downhole system 20 comprising a logging unit 17, a liner setting unit 11 and a control unit 12 is used to place the liners 8, 9 in an overlapping relationship with a sufficiently strong part of the casing 2. The logging unit is arranged in a front part of the system to measure the characteristics of a casing 2 downhole in order to identify a zone 1 having a casing characteristic outside the predetermined interval and a part within the zone 1 having a casing characteristic within the predetermined interval.

When the characteristics have been measured, the control unit 12 determines the positions of the measured characteristics, and the zone 1 and the part within the zone are identified. Then, the liner setting unit 11 comprising two liners 8, 9 is positioned opposite the zone, and the liners are expanded so that they overlap the acceptable part but have a predetermined distance between them.

Figure 7A:
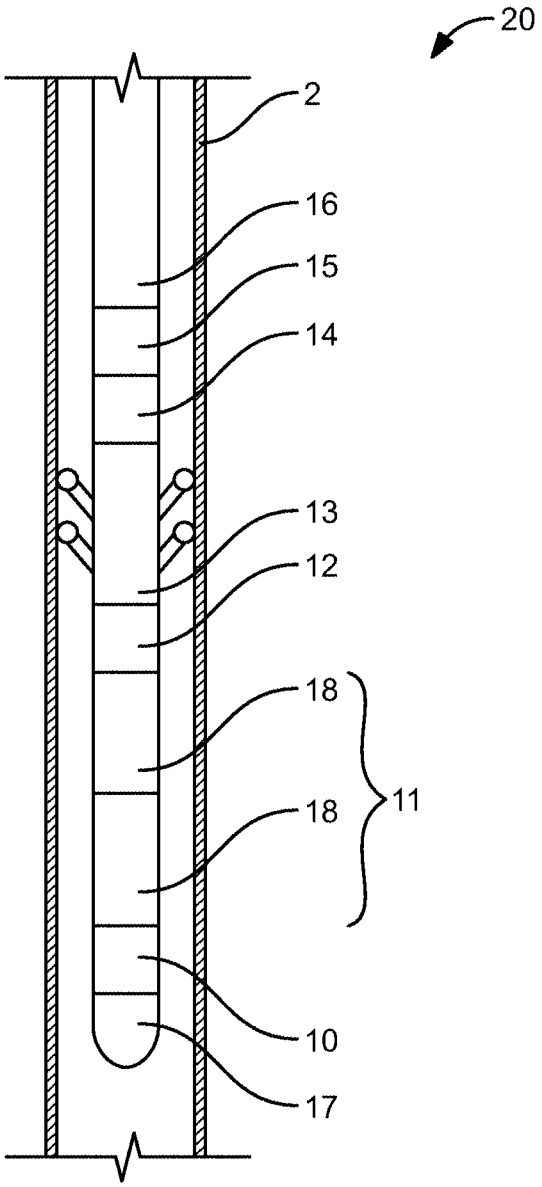
FIG. 7A shows a downhole system according to the present invention.

FIG. 7A shows a downhole system 20. The system 20 has a logging unit 17, a positioning tool 10, a liner setting unit 11 having two liner setting tools 18, a driving unit 13, a pump 14 and a motor 15. The system 20 is connected to a pipe string, such as a drill pipe or coiled tubing 16. The logging unit 17 measures the casing characteristics while being moved forward by the driving unit 13. The positioning tool 10 determines the position of the system, e.g. by means of magnetism, making it possible to calculate the position of the system when it passes a casing collar. The positioning tool 10 may be any kind of positioning tool, such as a casing collar locator, a distance measuring device, such as a winch, or a driving unit 13.

When the casing characteristics and the position related to the measured casing characteristic are known, the control unit 12 is able to determine the zone 1 in which the casing characteristic is outside a predetermined interval. Subsequently, the control unit 12 determines the parts and the extent of the parts having a casing characteristic outside the predetermined interval. The part 7 having a sufficient extent along the longitudinal direction of the casing 2 and being substantially in the middle of the zone 1 is identified. The driving unit 13 moves the system 20 in order to position the liner setting tools 18 opposite the zone 1, and the liner setting tools 18 each expand a liner to abut the inner face of the casing 2 so that one liner overlaps the first area P1 of the part 7 and the other liner overlaps the second area P2 of the part.

Each liner setting tool 18 comprises a liner, a body 22, an expansion device 21 and a shaft 23 for connecting the expansion device with the body 22. The body 22 and the expansion device 21 hold the liner in place while driving the system back and forth until the liner is in the position in which it is to be set.

Figure 7B:
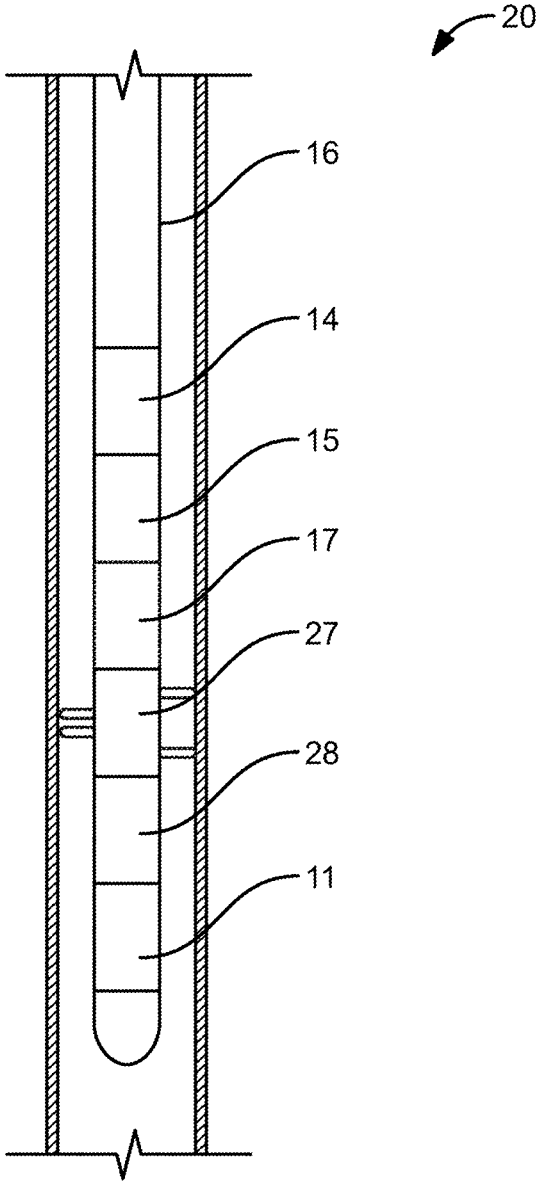
FIG. 7B shows another embodiment of the downhole system.

In FIG. 7B, the system 20 comprises an anchor tool 27 which is arranged so that it anchors the system against the casing 2 while expanding the liners 8, 9. The system 20 further comprises an axial force generator for providing the axial force of the liner setting unit 11. The axial force generator 28 comprises a pump 14 moving a piston assembly and thus a piston shaft in an axial direction of the system 20, but may be any kind of tool capable of generating such an axial force, such as a Well Stroker®. Furthermore, the logging unit 11 has been arranged in the end of the system 20 closest to the wireline 19, and the pump 14 is driven by fluid pumped down through the pipe string 16 for driving the motor 15. The motor powers the logging unit 17.

Figure 8A:
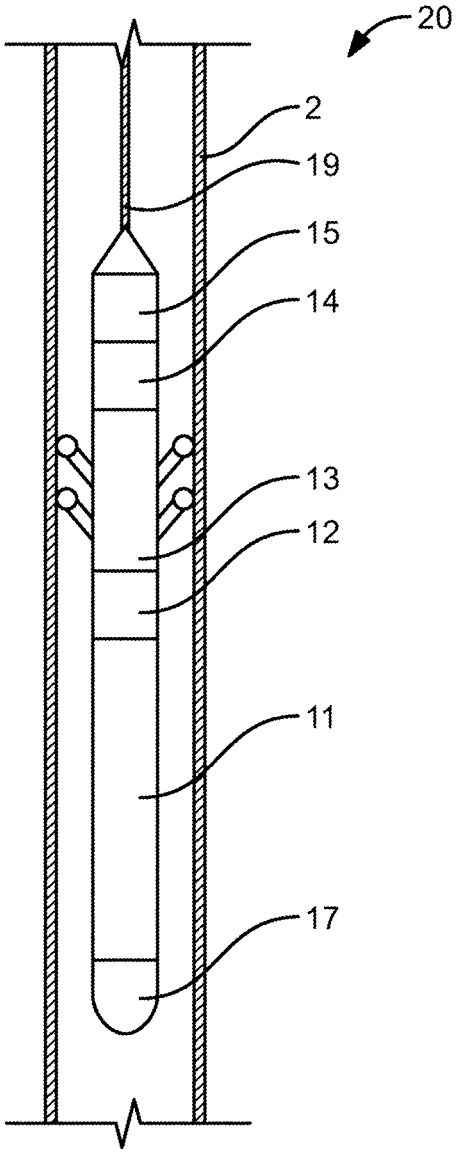
FIGS. 8A and 8B show other embodiments of the downhole system.

FIG. 8A shows another downhole system 20. This system 20 is run on and powered through wireline 19. The downhole system 20 comprises a logging unit 17, a liner setting unit 11, a control unit 12, a driving unit 13, a pump 14 and a power unit 15, such as an electrical motor. In this system, the liner setting unit 11 comprises a body 22 and at least one expansion device 21 for expanding the liners 8, 9 where the expansion device 21 is moved in relation to the body 22 to expand the liners. The motor is an electrical motor driving the pump 14 which again powers the driving unit 13 and the liner setting unit 11. The logging unit 17 is also powered by the motor.

The control unit 12 is arranged in the system 20 to determine the position and extent of the zone 1 and to identify the part which the liners can overlap. In another embodiment, the control unit 12 is situated away from the casing 2 and communicates with the tools through the wireline 19. Having the control unit 12 as part of the tool string in the casing 2 makes the communication faster and substantially prevents interference and delay. However, when the control unit 12 is above the well 3, an operator can view and control the different operations, and the choice of zone 1 and the acceptable part can be adjusted.

Figure 8B:
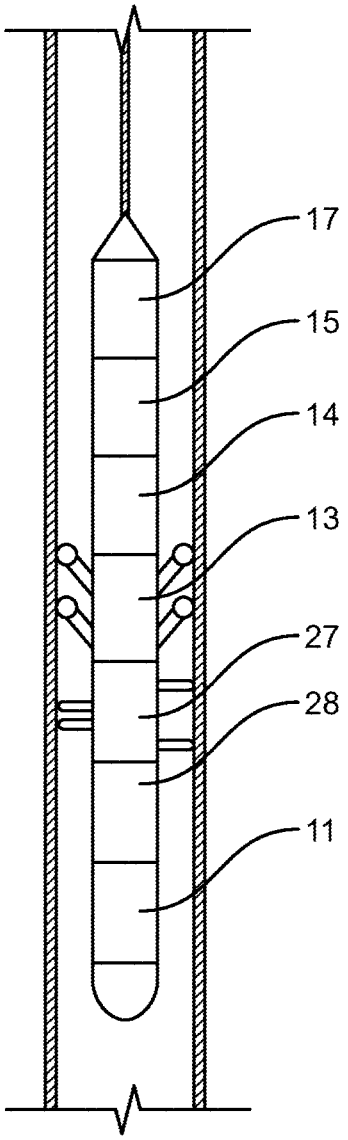

In FIG. 8B, the system 20 comprises an anchor tool 27 which is arranged so that it anchors the system against the casing 2 while expanding the liners 8, 9. The system 20 further comprises an axial force generator for providing the axial force of the liner setting unit 11. Furthermore, the logging unit 11 has been arranged in the end of the system 20 closest to the wireline 19.

Even though not shown, the system may be divided into separate tool strings so that the logging unit 17 and the liner setting unit 11 are two separate tool strings, each driven by a driving unit 13.

Figure 9:
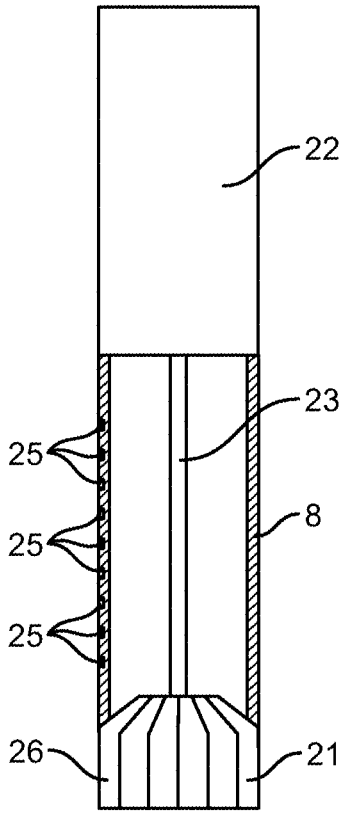
FIG. 9 shows an expansion device.

FIG. 9 shows the liner setting tool 18 comprising a liner 8, 9, a body 22, an expansion device 21 and a shaft 23 for connecting the expansion device 21 with the body 22. The liner is maintained in a position between the expansion device and the body 22, and when the liner is opposite the casing section in which it is to be expanded, the expansion device 21 is drawn towards the body 22, forcing the liner outwards. The expansion device 21 is an expandable cone which is expanded from one diameter to a larger diameter before expanding the liner.

Figure 10:
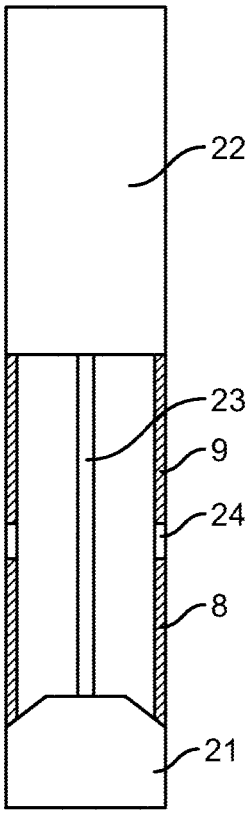
FIG. 10 shows another embodiment of the expansion device.

FIG. 10 shows the liner setting unit 11 comprising two liners 8, 9. The liners 8, 9 are fixated between the body 22 and an expansion device 21, and the shaft 23 connects the expansion device with the body 22. Between the liners 8, 9, a spacer 24 is arranged. The spacer 24 has a length corresponding to the extension of the third area P3 of the acceptable part 7. The spacer 24 is shaped as a ring and is made of a material which crunches when expanded by the expansion device 21. The second liner 9 is not fastened when the expansion device 21 crunches the spacer ring, but as soon as the expansion device moves further towards the body 22, the second liner is centralised by the inclined part of the cone and is thus subsequently fastened again. The cone is in this embodiment not expandable.

Figure 11:
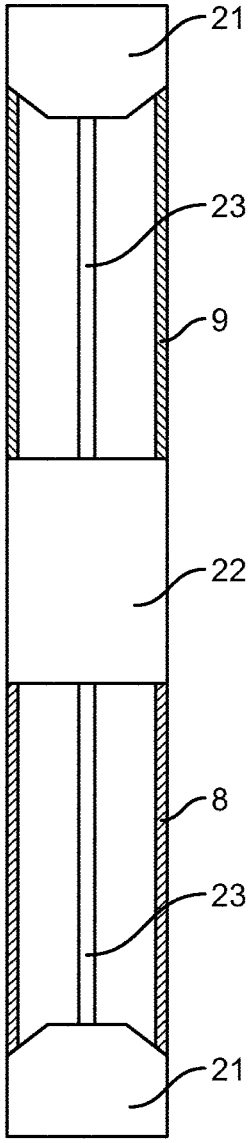
FIG. 11 shows yet another embodiment of the expansion device.

In FIG. 11, the liner setting unit 11 comprises two liners 8, 9 arranged on opposite sides of one body 22. Two shafts 23 extend from the body 22 in opposite directions of the longitudinal direction of the liner setting unit 11 and extend within each of the liners 8, 9. In the end opposite the end connected with the body 22, each shaft 23 is connected with an expansion device 21. In one embodiment, one shaft 23 has a greater diameter than the other, causing one shaft to move into the other when the liners 8, 9 are expanded. Thus, the body 22 can be designed with a short extension along the longitudinal extension of the system 20 in order to fit the third area P3 of the part 7.

The liner setting unit may comprise two bodies, two liners and two expansion devices. The two liners are arranged between the two bodies, and the two expansion devices are arranged between the two liners each moving towards one of the bodies for expanding one of the liners, the liner setting unit comprising a shaft for connecting the expansion devices with the bodies. In this way, two liners can be arranged having a predetermined distance being the distance of the two expansion devices. When expanding the liners, they will shrink in length, but starting the expansion in that end of a liner facing the other liner result in the distance between the liners being independent of the shrinkage during expansion.

In another embodiment of the system, the system 20 has more than two liner setting tools 18, or the liner setting unit 11 has more than two liners 8, 9. Hereby, the system 20 is useful if the zone 1 has a length demanding three liners. Where this is the case, a second part of the zone 1 having an acceptable casing characteristic will have to be identified as well. Like the first and second liners 8, 9, the third liner is expanded in an overlapping relationship with the second area P2 of the second part. In another embodiment, the liner setting unit 11 has a cutting unit for cutting the liner into a predetermined length. The cutting unit makes it possible to shorten one liner to fit the actual extension of the zone 1 and the distance between two acceptable parts 7. If the zone 1 is too long for two liners to cover the entire zone, but the parts 7 are closer together than the length of one liner, the liner can be shortened to fit.

The system 20 may comprise two expansion devices 21, one for each liner, so that one half of the liner is expanded by one expansion device and the other half is expanded by the other expansion device. The expansion devices 21 may move towards each other simultaneously. In addition, the first expansion device 21 may expand the liner from one diameter to a second diameter, and the second expansion device may expand the liner from the second diameter to a third diameter.

Furthermore, the body 22 may comprise fastening means and/or sealing means 25 to be able to fasten the liner properly and/or seal the space inside the liner.

The expansion device 21 may have any suitable shape, such as a mandrel, a cone, etc. Furthermore, the device 21 may have rollers arranged in a rolling connection on the outside of the mandrel or cone. The expansion device 21 may comprise means for expanding the outer diameter of the device to a larger diameter before expanding the liner. Thus, the expansion device 21 may be divided into radially movable sections 26, as shown in FIG. 9.

The casing characteristics measured to identify both the position and the extent of the zone 1 and the part 7 are often comprised of a series of measurements indicating a wall thickness of the casing 2. The measurements may also be a density of a material of the casing 2, a thermal conductivity of a material of the casing, a strength of a material of the casing, a porosity of a material of the casing, or a combination thereof.

The downhole system 20 may comprise several driving units 13 for driving the system faster in the well 3 or for being able to move the system at all.

Furthermore, the driving unit 13 has means for driving the system, such as wheels, extending in a first direction transverse to the longitudinal direction of the casing 2. Therefore, the system may need an additional driving unit 13 in order to centralise the system 20 in another direction transverse to the first direction.

As shown in FIG. 9, the liner comprises sealing means 25. When expanding a metal liner, the liner will shrink a little bit when the tension of the expansion device 21 has been released, and the sealing means 25 will fill and seal any gap between the inner face of the casing 2 and the outer face of the liner.

Aside from using the logging unit 17 for measuring casing characteristics before expanding the liners 8, 9, the logging unit 17 may also be used for measuring the casing characteristics when the liners have been expanded. In this way, the logging unit 17 can verify that the liners do not overlap each other and that they are positioned correctly. Furthermore, the logging unit 17 can determine the position and extent of a gap between the first and second expanded liners, which should be equal to the extent of the third area.

The downhole system 20 may comprise a filling device for filling up the gap between the first and second expanded liners with a filling material. The filling device may be a welding apparatus. When a section has been welded, it may subsequently be machined, if necessary. After filling up the gap with welding material, the logging unit 17 can be used to verify that the gap has been filled sufficiently.

The measuring of the casing characteristics may be performed by any suitable logging tool, such as tools using acoustic signals, such as vibration, sound, ultrasound or infrasound, capacitance or magnetism, or emit electromagnetic radiation with a frequency of $10^{11}$-$10^{19}$ Hz, such as X-rays, UV, visible light and infrared light. The emitting device may thus be a laser. The emitting device may also use microwaves having a frequency of 300 MHz-300 GHz.

In another embodiment, the expansion device 21 is held in place inside the casing 2 by means of anchors, slips or similar means while expanding the liners. Such means may be positioned either in the expansion device 21 or in another connected tool. The expansion device 21 may also be held in place inside the casing 2 by means of a downhole tractor.

By a liner is meant any kind of expandable tube used to cover or seal a leak 4, perforations 5 or openings on the inside of a casing 2 or strengthen a weakened part 6 of the casing, such as a lining, a patch, a tubing, a tubular, a clad, a seal or the like.

By fluid or well fluid is meant any kind of fluid that may be present in oil or gas wells downhole, such as natural gas, oil, oil mud, crude oil, water, etc. By gas is meant any kind of gas composition present in a well 3, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing 2 is meant any kind of pipe, tubing, tubular, liner, string etc. used downhole in relation to oil or natural gas production.

In the event that the system is not submergible all the way into the casing 2, a downhole tractor can be used to push the tool all the way into position in the well 3. The downhole tractor can also be used as a positioning tool 10 by measuring the distance which the tractor travels in the casing. A downhole tractor is any kind of driving unit 13 capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A sealing method for sealing an imperfect zone of a casing in a well, comprising:

measuring a characteristic of the casing, the characteristic being related to structural damage or weakening of the casing at a particular location;

evaluating the characteristic and classifying the characteristic as acceptable or imperfect along a plurality of locations in a longitudinal section of the casing relative to a predetermined value;

locating a first damaged or weakened zone randomly located in the casing, the first damaged or weakened zone comprising two discrete damaged or weakened sections of the casing, the first damaged or weakened section of the casing being separated longitudinally from the second damaged or weakened section of the casing by an acceptable region;

positioning a first liner overlapping the first damaged or weakened section and a first portion of the acceptable region;

positioning a second liner overlapping the second damaged or weakened section and a second portion of the acceptable region different from the first portion;

ensuring a third portion of the acceptable region exists between the first portion and second portion and dimensioning the third portion to have a minimum predetermined extent based on the locating of the first and second damaged or weakened zones such that no liner overlaps the third portion;

expanding the first liner; and expanding the second liner.

2. The sealing method according to claim 1, wherein the measuring is performed by means of acoustics.

3. The sealing method according to claim 1, wherein the positioning is performed by means of a casing collar locator, a positioning tool using magnetism, or a distance measuring device.

4. The sealing method according to claim 1, wherein the expanding is performed by means of an expansion device.

5. The sealing method according to claim 1, wherein the method comprises determining a second damaged or weakened zone as well as a second acceptable region and a third damaged or weakened section within the second damaged or weakened zone, the second acceptable region being arranged longitudinally adjacent to the first damaged or weakened zone.

6. The sealing method according to claim 1, wherein:

the measuring step comprises a logging unit for measuring the characteristics of a casing downhole, the evaluating step comprises a control unit for evaluating the characteristic and locating a position along the casing in which the characteristic has been measured, and the positioning step comprises a liner setting unit comprising the first liner and the second liner.

7. The sealing method according to claim 6, wherein the liner setting unit comprises a body and at least one expansion device for expanding the liners.

8. The sealing method according to claim 6, wherein the liner setting unit comprises at least two liner setting tools, each liner setting tool comprising a liner, a body, an expansion device and a shaft for connecting the expansion device with the body.

9. The sealing method according to claim 6, wherein the liner setting unit comprises the two liners, a body, an expansion device and a shaft for connecting the expansion device with the body.

10. The sealing method according to claim 9, wherein the liner setting unit comprises the two liners arranged between two bodies and two expansion devices arranged between the two liners each moving towards one of the bodies for expanding one of the liners, the liner setting unit comprising a shaft for connecting the expansion devices with the bodies.

11. The sealing method according to claim 6, further comprising a positioning tool.

12. The sealing method according to claim 6, further comprising moving the downhole system in the casing with a driving unit.

13. The sealing method according to claim 6, wherein the liner setting unit comprises an expandable device and a liner.

14. The sealing method according to claim 2, wherein the acoustics include ultrasound, vibration, sound or infrasound, capacitance, magnetism, X-ray, infrared light, visible light, laser, UV light, or microwaves.

15. The sealing method of claim 1, wherein the structural damage or weakening is a result of an unexpected perforation in the casing or a decrease in a thickness of the casing relative to a previously measured portion of the casing.

16. The sealing method according to claim 1, wherein the damaged or weakened zone is a result of unexpected leaks, perforations, and/or weakened locations in the casing.

* * * * *